US009549614B2

(12) United States Patent
Bock

(10) Patent No.: US 9,549,614 B2
(45) Date of Patent: Jan. 24, 2017

(54) MECHANISM FOR AN OFFICE CHAIR

(71) Applicant: BOCK 1 GMBH & CO. KG, Postbauer-Heng (DE)

(72) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 14/679,163

(22) Filed: Apr. 6, 2015

(65) Prior Publication Data

US 2015/0282620 A1 Oct. 8, 2015

(30) Foreign Application Priority Data

Apr. 4, 2014 (DE) ..... 10 2014 104 870

(51) Int. Cl.
*A47C 1/032* (2006.01)

(52) U.S. Cl.
CPC ..... *A47C 1/03211* (2013.01); *A47C 1/03255* (2013.01); *A47C 1/03266* (2013.01); *A47C 1/03272* (2013.01); *A47C 1/03294* (2013.01)

(58) Field of Classification Search
CPC ..... A47C 1/03255; A47C 1/03261; A47C 1/03266; A47C 1/03272; A47C 1/03211; A47C 1/03294
See application file for complete search history.

(56) References Cited

U.S. PATENT DOCUMENTS 5,026,117 A * 6/1991 Faiks ..... A47C 3/026 267/131
7,080,884 B2 * 7/2006 Daeschle ..... A47C 1/03255 297/300.8
7,147,285 B2 12/2006 Lin
7,766,426 B2 * 8/2010 Meidan ..... A47C 1/03238 297/302.7
7,815,257 B2 10/2010 Costaglia et al.
7,850,237 B2 * 12/2010 Gorgi ..... A47C 1/03255 297/303.1
2004/0140703 A1 * 7/2004 Bock ..... A47C 1/03255 297/300.5
2010/0308633 A1 12/2010 Donati

FOREIGN PATENT DOCUMENTS

| | | | |
|---|---|---|---|
| EP | 1258212 | A2 | 11/2002 |
| EP | 1537804 | A1 | 6/2005 |
| JP | 2008132322 | A | 6/2008 |
| WO | 2009057168 | A1 | 5/2009 |

* cited by examiner

*Primary Examiner* — Philip Gabler
(74) *Attorney, Agent, or Firm* — Laurence A. Greenberg; Werner H. Stemer; Ralph E. Locher

(57) ABSTRACT

An office chair mechanism includes a base support for placement on a chair column, a seat support on the base support being movable relative to the base support and a backrest coupled to the seat support. Pivoting the backrest moves the seat support relative to the base support. A track element is movably connected at a base support connecting point to the base support and at a seat support connecting point to the seat support to adjust pivoting resistance of the backrest. Pivoting the backrest alters position and/or location of the track element. A spring element acting on the track element and on the seat support or on the backrest and/or a backrest support is acted upon with a movement of the seat support relative to the base support. An adjustment device alters the position of a point of action of the spring element on the track element.

17 Claims, 7 Drawing Sheets

MECHANISM FOR AN OFFICE CHAIR

CROSS-REFERENCE TO RELATED APPLICATION

This application claims the priority, under 35 U.S.C. §119, of German Patent Application DE 10 2014 104 870.9, filed Apr. 4, 2014; the prior application is herewith incorporated by reference in its entirety.

BACKGROUND OF THE INVENTION

Field of the Invention

The invention relates to a mechanism for an office chair including a base support which is able to be placed on a chair column, a seat support which is disposed on the base support and which is able to be moved relative to the base support and a backrest coupled to the seat support, wherein a pivoting of the backrest effects a movement of the seat support relative to the base support.

Such a mechanism, which is used as a subassembly in a seat subframe of an office chair, provides a kinematic system causing a specific relative movement of the seat and backrest relative to one another, so that a correlated seat-backrest movement results.

Numerous devices for altering the motion characteristic of such a mechanism are known from the prior art, in particular for altering the pivoting resistance of the backrest. Conventionally, by using an actuating element, for example a rotary crank or the like, a setting is selected between "hard" and "soft," depending on whether the user of the office chair is a heavy or light person. Those devices for altering the motion characteristic are often complex structurally.

SUMMARY OF THE INVENTION

It is accordingly an object of the invention to provide a mechanism for an office chair, which overcomes the hereinafore-mentioned disadvantages of the heretofore-known mechanisms of this general type and which provides an alternative way of adjusting the pivoting resistance of the backrest of an office chair.

With the foregoing and other objects in view there is provided, in accordance with the invention, a mechanism for an office chair, comprising a base support which is able to be placed on a chair column, a seat support which is disposed on the base support and which is able to be moved relative to the base support, a backrest coupled to the seat support, wherein a pivoting of the backrest effects a movement of the seat support relative to the base support, a track element which, on one hand, is movably connected at a base support connecting point to the base support and, on the other hand, is movably connected at a seat support connecting point to the seat support, wherein a pivoting of the backrest effects an alteration to the position and/or the location of the track element, a spring element acting, on one hand, on the track element and, on the other hand, on the seat support or on the backrest, wherein the spring element is acted upon with a movement of the seat support relative to the base support, and an adjustment device for altering the position of the point of action of the spring element on the track element.

The invention is based on the recognition that the pivoting resistance of the backrest of the office chair is adjusted by altering the position of a point of action of the spring element. As a result, the spring path of the spring element is altered. Therefore, the spring force and thus the pivoting resistance of the backrest may be set to be stronger or weaker and thus adapted to different body weights of the user for the same pivoting path of the backrest.

A basic concept of the invention is to alter the position of the point of action of the spring element in a particularly simple and elegant manner, in that it is provided to permit the spring element not to act directly on one of the main components of the mechanism but instead to use a coupling element connecting together the two main components of the mechanism which are relevant in this case, namely the seat support and the base support, with the coupling element cooperating with the spring element and the spring element acting thereon at a specific point of action. Since one main component, namely the base support, is generally fixed while the other main component, namely the seat support, during a pivoting of the backrest support moves therewith and at the same time performs a movement relative to the base support, which may also be the case when the base support performs a movement during a pivoting of the backrest support, the invention advantageously makes use of the possibility of using the different motion characteristics of these two main components for adjusting the pivoting resistance. To this end, according to the invention, the position of the point of action of the spring element on the track element may be altered and namely in such a way that the spring element is able to act both at a point of action in the vicinity of the connecting point of the track element to the base support and at a point of action in the vicinity of the connecting point of the track element to the seat support and preferably also at any point between these two extremes, with the backrest being pivoted against the spring force of the spring element which in this case is subjected to a force.

With a movement of the seat support relative to the base support due to a pivoting of the backrest, the point of action of the spring element on the track element moves more or less with the seat support, in a position of the point of action which is in the vicinity of the seat support connecting point, while the point of action of the spring element on the seat support or on the backrest provided on the opposing spring end, moves in any case with these components. A pivoting of the backrest, therefore, leads only to a relatively weak action on the spring element, if at all. The spring path is short (minimal) and the pivoting resistance and/or the restoring force of the spring element very small ("soft setting").

If, however, the point of action of the spring element is located on the track element in a position in the vicinity of the base support connecting point, this point of action then remains more or less at the same location during a pivoting of the backrest while the point of action of the spring element on the seat support or on the backrest provided on the opposing spring end moves therewith and away from this location during the pivoting movement of the backrest. A pivoting of the backrest in this case leads to a relatively powerful action on the spring element. The spring path is long (maximum) and the pivoting resistance and/or the restoring force of the spring element very high ("hard setting").

Through the use of the present invention, by altering the position of a point of action of the spring element in a particularly simple and elegant manner structurally, the pivoting resistance effectively acting on the backrest is altered.

Other features which are considered as characteristic for the invention are set forth in the appended claims.

Although the invention is illustrated and described herein as embodied in a mechanism for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 1 to 4 are diagrammatic, plan views showing the main principle of the invention, in which:

FIG. 1 shows individual mechanism components in a "light" setting in an initial position, FIG. 2 shows the view of FIG. 1 in a pivoted-out position, FIG. 3 shows individual mechanism components in a "heavy" setting in an initial position, and FIG. 4 shows the view of FIG. 3 in a pivoted-out position;

FIGS. 5 to 11 are views showing structural details of an embodiment of the mechanism according to the invention, in which:

FIG. 5 is a side-elevational view of the mechanism in an initial position,

FIG. 6 is a side-elevational view of the mechanism of FIG. 5 in a pivoted position, FIG. 7 is a plan view of the mechanism in the "light" setting in an initial position, FIG. 8 is a plan view as in FIG. 7 in a maximum pivoted position to the rear, FIG. 9 is a plan view of the mechanism in the "heavy" setting in an initial position, FIG. 10 is a plan view as in FIG. 9 in a maximum pivoted position to the rear, FIG. 11 is a fragmentary, sectional view of an adjustment device.

DETAILED DESCRIPTION OF THE INVENTION

Figure 1:
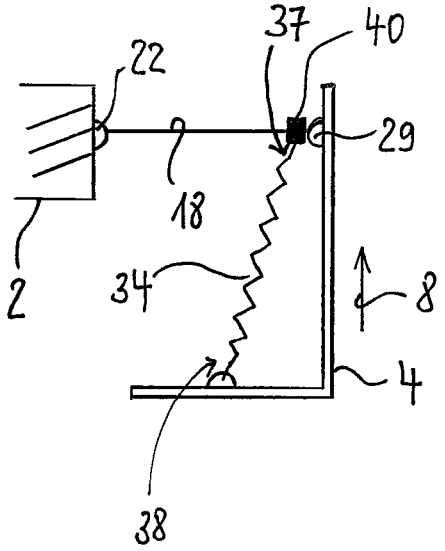
Figure 2:
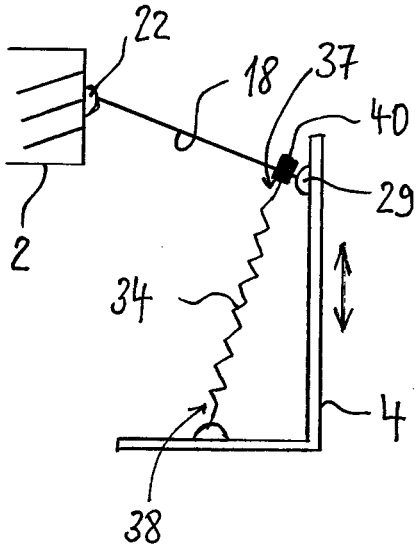
Figure 3:
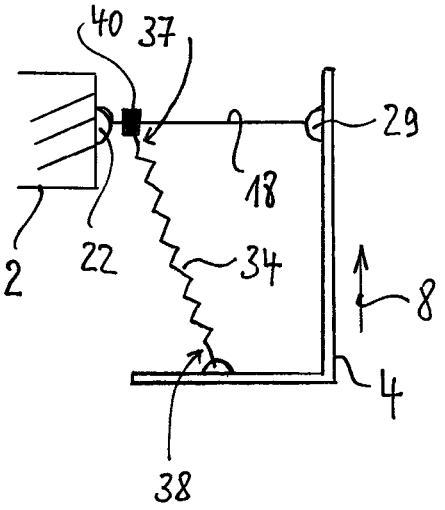
Figure 4:
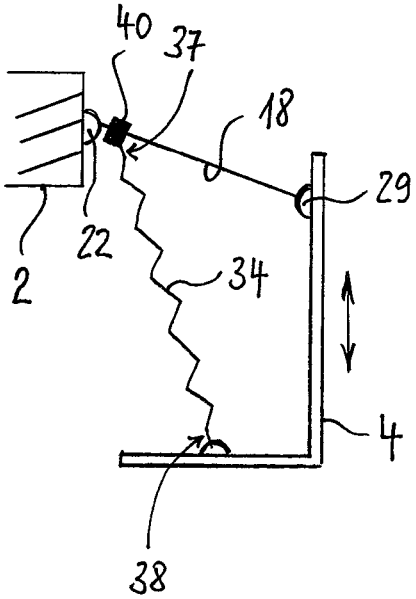

Referring now in detail to the figures of the drawings, which are merely diagrammatic and show important components of the invention and in which the same reference numerals correspond to elements having the same or comparable function, and first, particularly, to FIGS. 1-4 thereof, it is seen that a general operating principle on which the invention is based rests on the fact that a connection is produced between a first, preferably fixed component 2, for example a base support of a mechanism for an office chair, and a second movable component 4, for example a seat support of the mechanism, by using a connecting element 18. One end 37 of a spring element 34, which is able to be adjusted in terms of location, acts on the connecting element 18 by forming a point of action 40, while an opposing fixed other end 38 of the spring element 34 acts on the second component 4. If the point of action 40 of the adjustable end 37 of the spring element 34 is located in the vicinity of a connecting point 29 of the connecting element 18 to the second component 4, as shown in FIGS. 1 and 2, and it results in a movement of the second component 4 relative to the first component 2 from a basic position (FIG. 1) into a pivoted-out position (FIG. 2), as is the case by way of example when the second component 4 is moved due to a movement of a third component, for example due to a pivoting of a backrest support of the mechanism, then the spring element 34 is not acted upon or only slightly acted upon since the adjustable end 37 of the spring element 34 moves therewith. If, however, the adjustable point of action 40 of the spring element 34 is located in the vicinity of a connecting point 22 of the connecting element 18 to the first component 2, as shown in FIGS. 3 and 4, and it results in a movement of the second component 4 relative to the first component 2 from a basic position (FIG. 3) into a pivoted-out position (FIG. 4), then the spring element 34 is powerfully acted upon since the fixed end 38 of the spring element 34 significantly moves away from the adjustable end 37 of the spring element 34.

Figure 5:
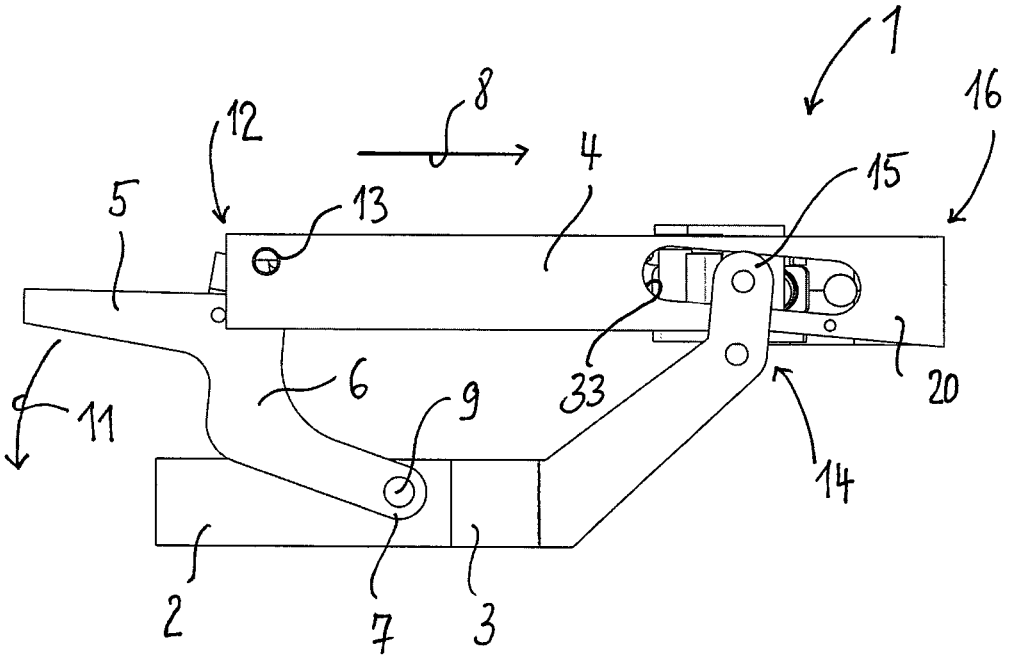
Figure 6:
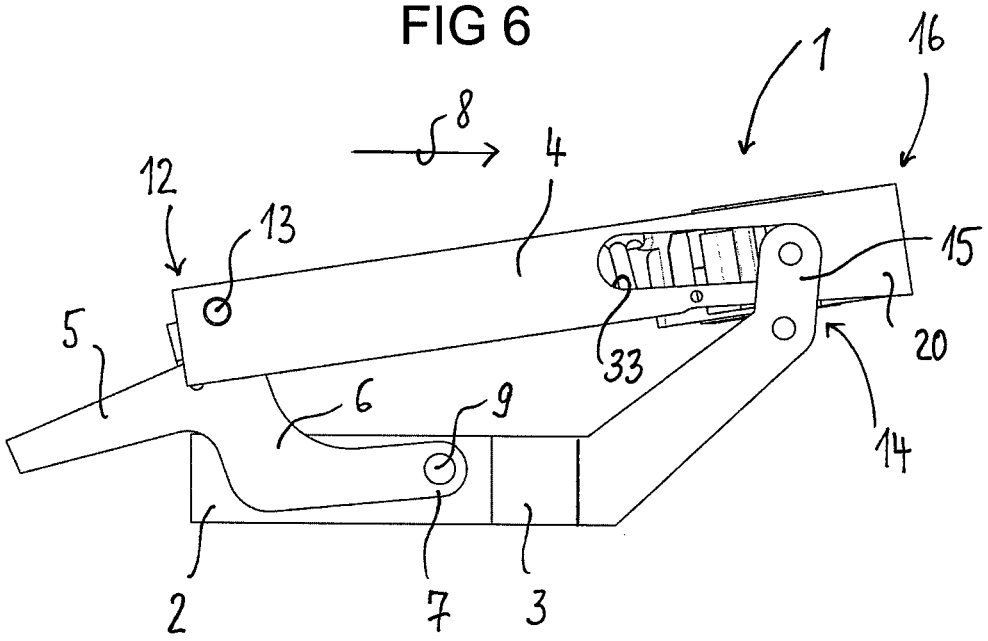
Figure 7:
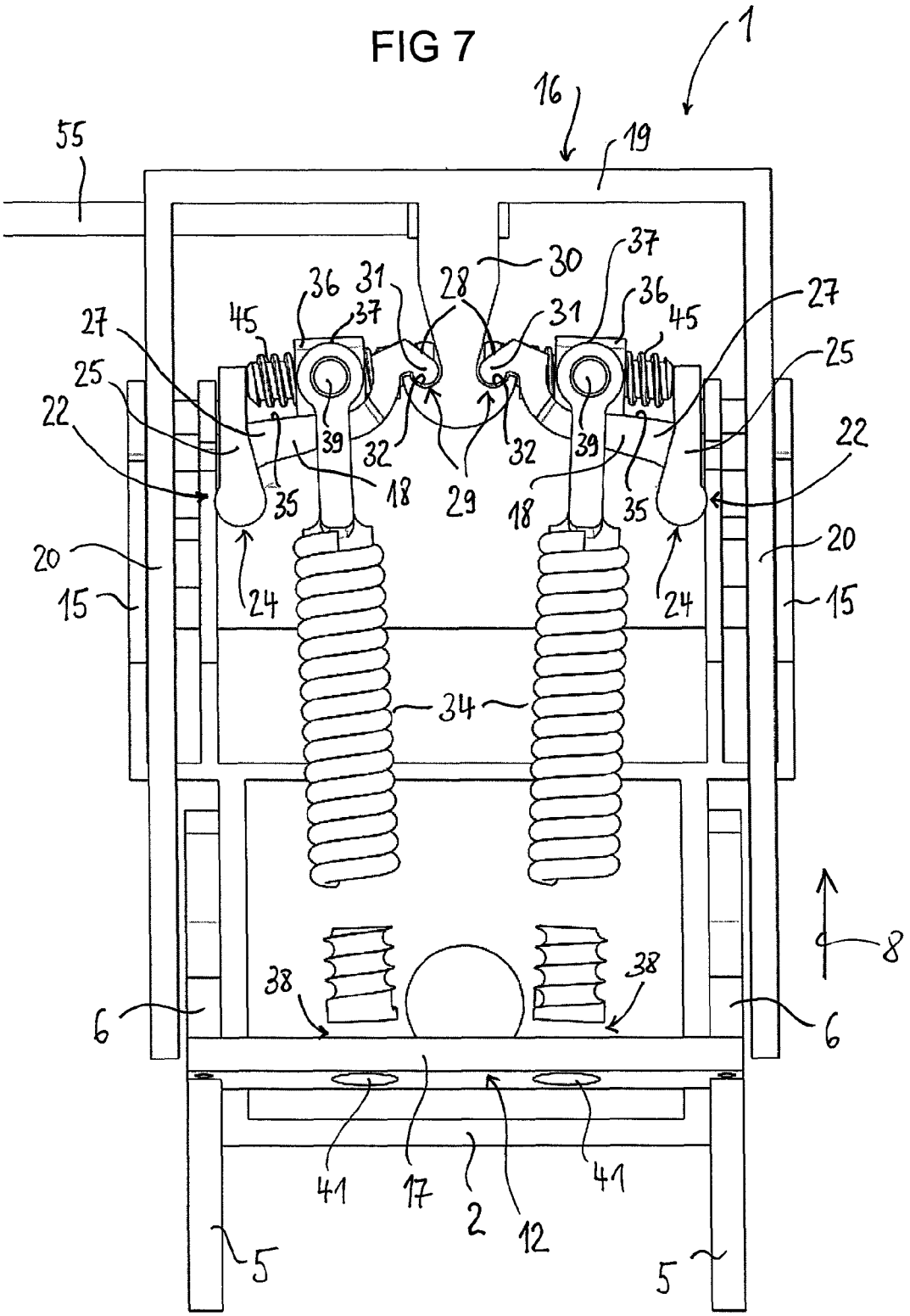

Initially, the general construction and the movement of a mechanism 1 will be described below. As is seen in FIGS. 5 and 6, the mechanism 1 has a base support 2 which is placed onto the upper end of a non-illustrated chair column by using a conical receptacle 3. The mechanism 1 includes a seat support 4 and a backrest support 5 which is fork-shaped in a plan view and has cheeks 6 disposed on both sides of the base support 2. The seat of the office chair, which is generally provided with a non-illustrated upholstered seating surface, is mounted on the seat support 4. In the example selected in this case, the backrest support 5 with free ends 7 of its cheeks 6 is pivotably connected in the vicinity of the conical receptacle 3 to the base support 2. In other words, the backrest support 5 may be pivoted downwardly to the rear relative to the fixed base support 2 about a pivot pin 9 extending transversely to a longitudinal seat direction 8 in a pivoting direction 11.

The cheeks 6 of the backrest support 5 at a rear end 12 of the seat support 4 are articulated on a region spaced apart from the free ends 7 by using a pivot pin 13 extending transversely to the longitudinal seat direction 8, in such a way that a pivoting of the backrest support 5 in the pivoting direction 11, i.e. from an initial upright position (FIG. 5) into a rear pivoted position (FIG. 6), is followed by a corresponding subsequent movement of the seat support 4 relative to the fixed base support 2. The manner of the coupling of the pivotable backrest support 5 to the seat support 4 is not important for the present invention. In this case it may be a direct or an indirect coupling.

A front end 14 of the base support 2 extends with two arms 15 ending on both sides of the seat support 4. The mechanism 1 has a mirror symmetrical construction relative to a central longitudinal plane, which relates to an actual kinematic system seen in FIGS. 7 to 10. In this regard, in the following description, reference is always made to structural elements of the mechanism 1 present in pairs on both sides. In FIGS. 7 to 10, the seat support 4 is not shown for improved clarification of the structural configuration of the mechanism 1.

The terms "at the front" or "front" in this case means that a component is disposed at the front in the longitudinal seat direction 8 and/or refers to a component extending in the direction of a front seat edge 16 and/or a component facing in this direction, while the terms "at the rear" or "rear" means that a component is disposed at the rear in the longitudinal seat direction 8 and/or refers to a component extending in the direction of the backrest and/or the backrest support 5 and/or a component facing in this direction. The terms "above" and/or "below" refer to the usage state of the office chair and/or the office chair mechanism 1 according to the intended use.

A pivoting strip 18 serving as a track element within the meaning of the invention is connected to each arm of the base support 2, as illustrated in FIGS. 7 to 11. The pivoting strip extends more or less transversely to the seat support longitudinal direction 8, depending on how far the backrest is pivoted.

One end 21 of the pivoting strip 18 is connected at a base support connecting point 22 to the base support 2, more specifically to an arm 15 of the base support 2, by using a suitable articulation forming a pivoting joint. To this end, a support element 24 which is pivotably fastened to the arm 15 about a pivot pin 23 running transversely to the longitudinal seat direction 8 and which extends substantially in the seat support longitudinal direction 8, is provided. The support element opens to the front in a fork-shaped manner and forms between its fork ends 25 a bearing 26 for the end 21 of the pivoting strip 18. The fork ends 25 in this case bear on both sides against side walls 27 of the pivoting strip 18, which in the non-pivoted initial position face upwards and downwards. The support element 24 is thus constructed as a type of double joint since it not only permits its rotation about the pivot pin 23 but is also suitable for providing an abutment to the pivoting strip 18 irrespective of its normal or oblique position adopted as a function of the pivoting.

An opposing other end 28 of the pivoting strip 18 is movably connected at a seat support connecting point 29 to the seat support 4, more specifically to a central projection 30 of the seat support 4 extending from a front seat support transverse frame 19 running in the seat support longitudinal direction 8. To this end, the elongated pivoting strip 18 at this end 28 is provided with an angled-back lug 31 which pivotably engages in a suitable receiver 32 of the projection 30 opening at the front and defining a point of rotation.

The base support 2 is thus connected to the seat support 4 through the two pivoting strips 18 as coupling elements. In this case, the arms 15 of the base support 2 or—depending on the viewing angle—the pivoting strips 18 and/or the support elements 24 being used, engage through lateral frame parts 20 of the seat support 4 which to this end have through-openings in the shape of slots 33.

Figure 8:
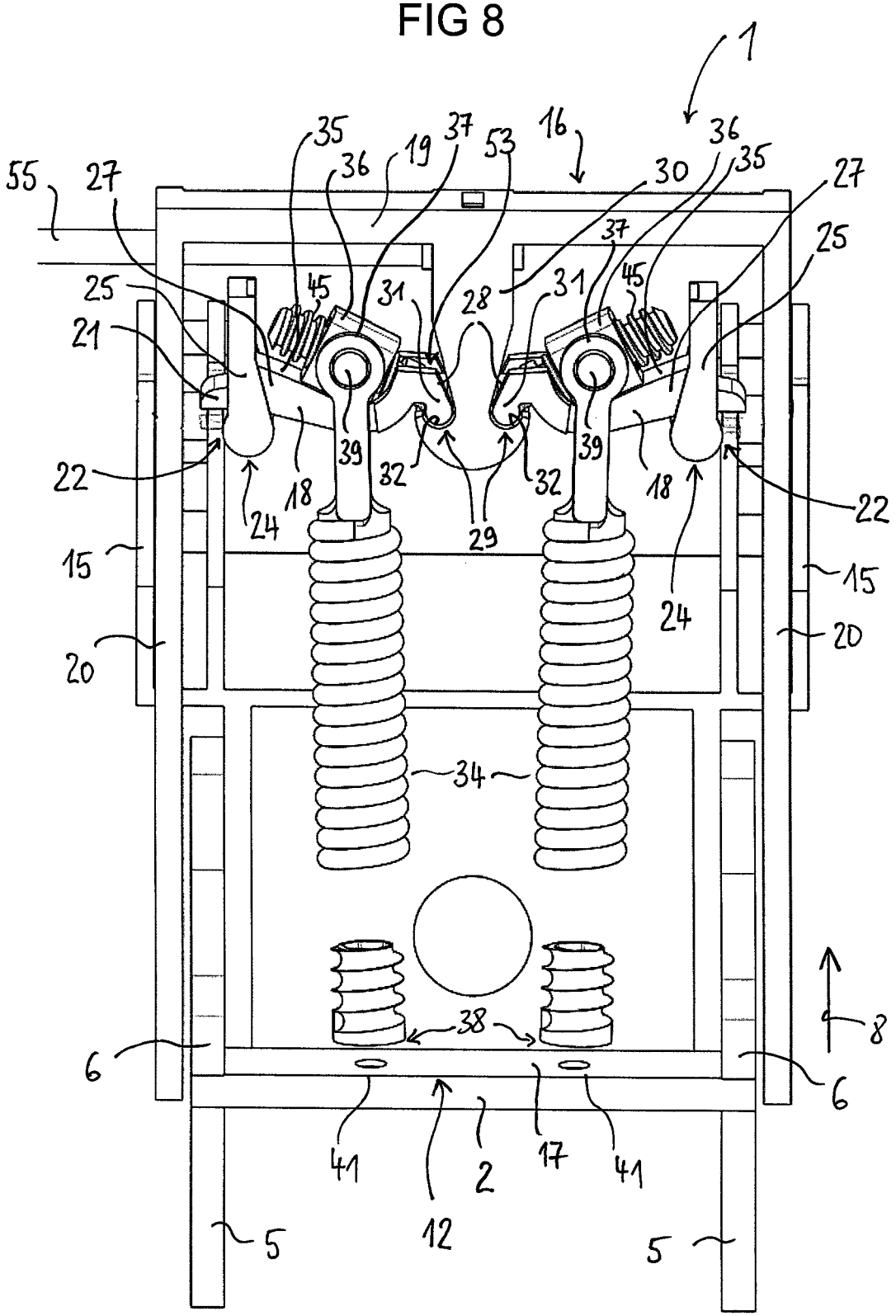
Figure 9:
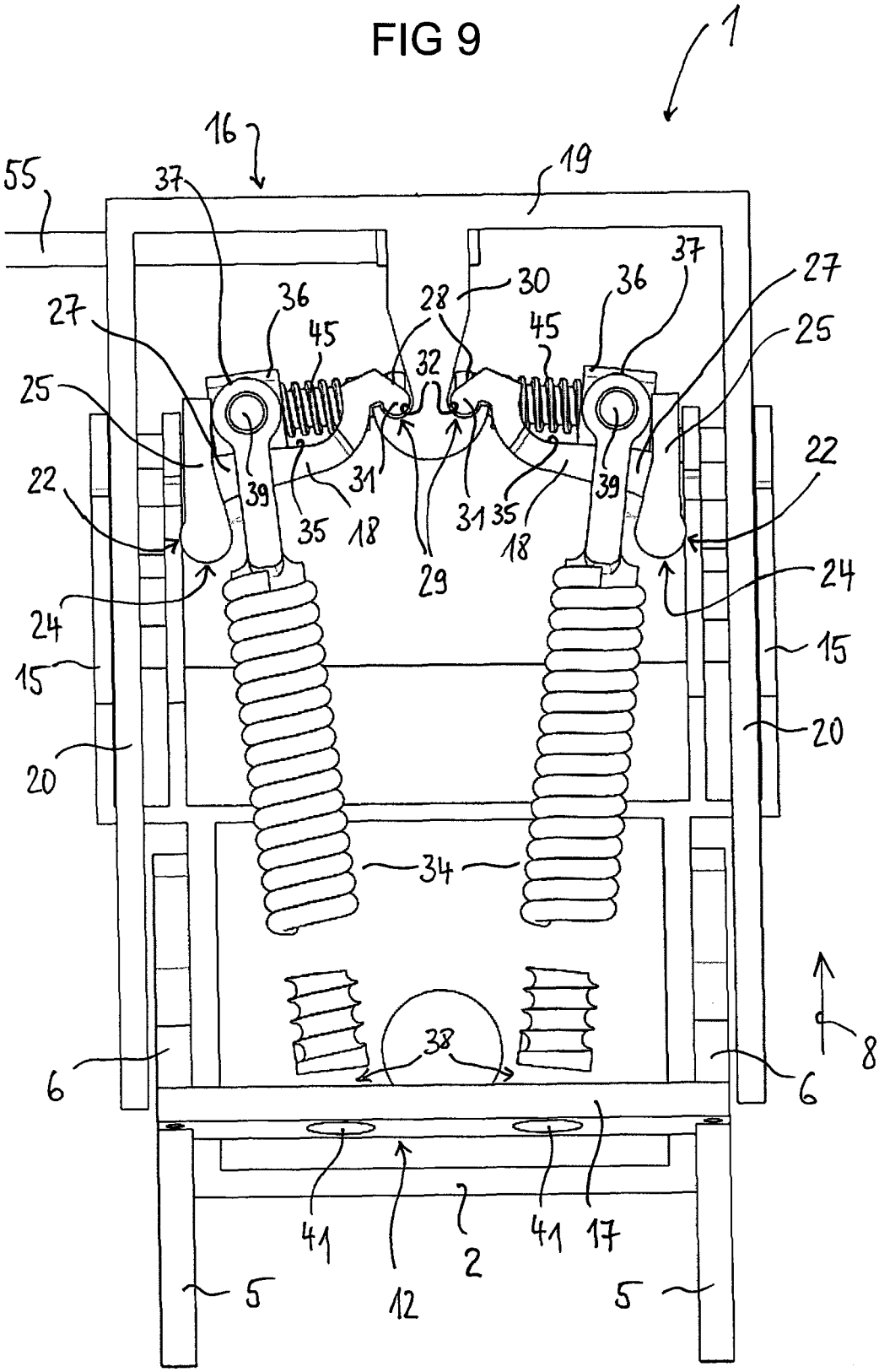
Figure 10:
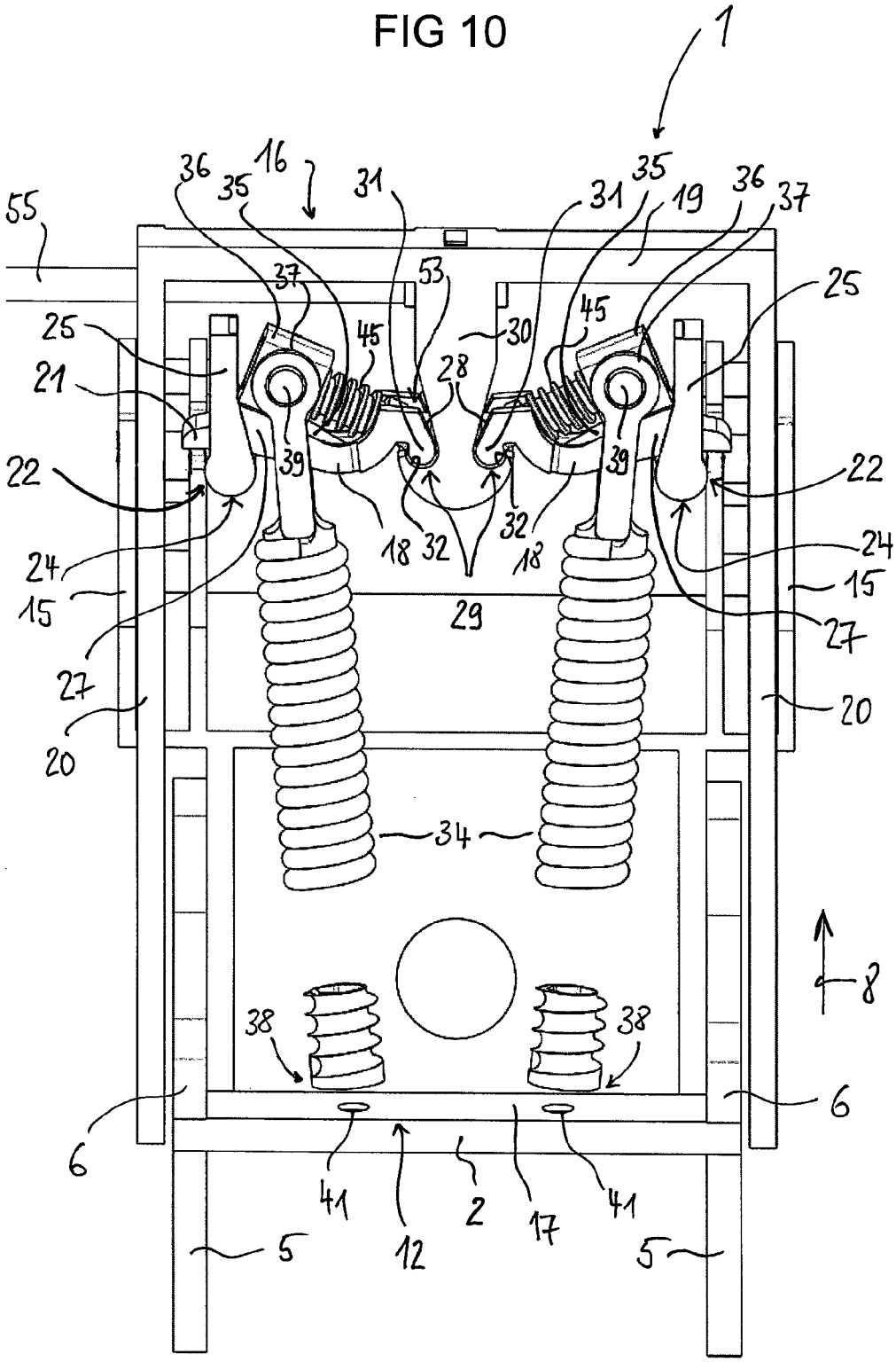

When pivoting the backrest from an initial position into a pivoted position (and back) the seat support 4 moves with the backrest support 5, which is coupled directly or indirectly to the seat support 4, in the pivoting direction 11 downwardly to the rear, whereby the base support connecting point 22 determined by the end of the fixed arm 15 of the base support 2 and/or the support element 24, moves to the front in the slot 33 of the seat support 4 (see FIGS. 8 and 10). The base support 2 thus forms with the seat support 4 a type of rotary joint/sliding joint. The basic concept of the invention is independent of the actual movement performed by the seat support 4 relative to the base support 2 during a pivoting of the backrest. Generally, however, the movement of the seat support 4 is a movement in the longitudinal seat direction 8 which is superimposed by a tilting movement or pivoting movement of the seat support 4.

In order to ensure that the backrest may perform a defined pivoting movement, the mechanism 1 includes spring elements 34 cooperating directly or indirectly with the backrest and/or the backrest support 5. The pivoting resistance of the backrest, when pivoted from an initial position into a pivoted position, is determined by using these spring elements 34, as well as the corresponding restoring force of the backrest.

Figure 11:
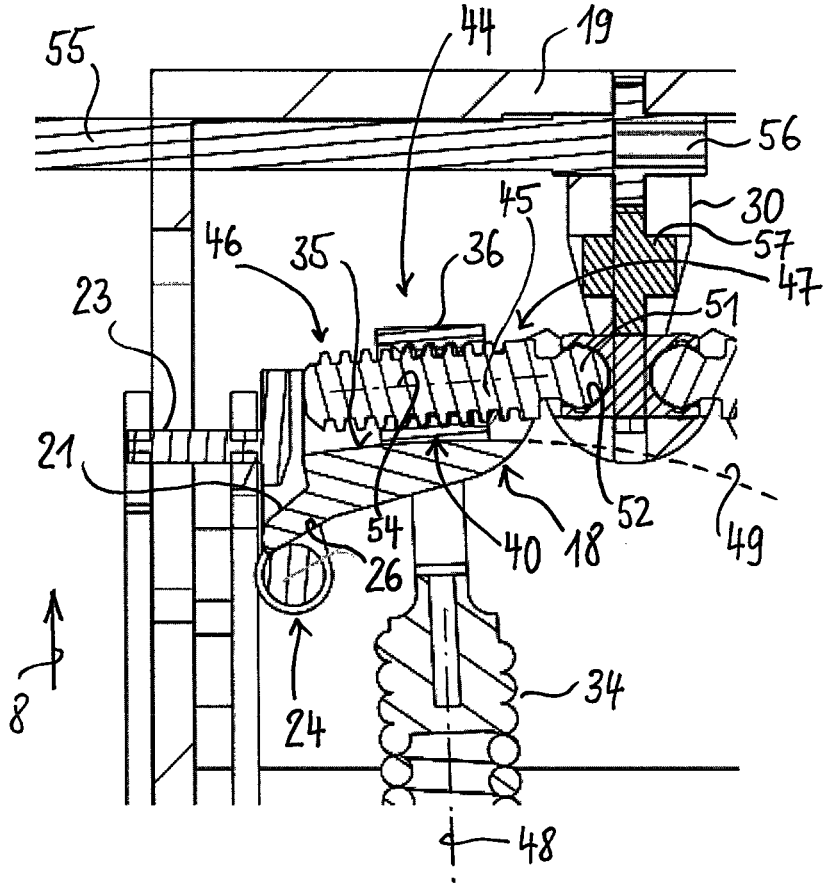

The cooperation of these spring elements 34 with the remaining components of the mechanism 1 is described hereinafter. A surface of the pivoting strip 18 facing to the front in the longitudinal seat direction 8 is configured as a bearing 35 for a threaded nut 36 serving as a support element. A front end 37 of a spring element 34 is pivotably articulated on the threaded nut 36, forming a suitable connecting point 39. In the simplest case, the spring element 34 is suspended there. The spring element 34 acts through the threaded nut 36 at a defined point of action 40 of the pivoting strip 18, as is seen in FIG. 11, namely at the point at which the threaded nut 36 is supported on the bearing 35 of the pivoting strip 18.

The spring element 34 in this case is a helical spring including a single winding, more specifically a helical tension spring. However, other spring elements 34 or spring assemblies including a plurality of spring elements 34 may also be used. The illustration of the spring elements 34 in the figures is partially incomplete.

An opposing rear end 38 of the spring element 34 acts on the seat support 4 in the rear region thereof, for example the rear end 38 of the spring element 34 is supported on a rear seat support transverse frame 17, and thus rear points of action 41 are defined, or the spring element 34 is suspended with the rear end 38 in the common pivot pin 13 of the seat support 4 and the backrest support 5. Alternatively, in a non-illustrated manner, the rear end of the spring element may also act directly on the backrest support.

In the example shown, two spring elements 34 are provided, acting with their front points of action 40 in each case on the pivoting strips 18 on both sides of the projection 30. The distance of the two rear points of action 41 of the spring elements 34 from one another in this case, both in the non-pivoted basic position and in the maximum pivoted position to the rear, is less than the distance of the two front points of action 40 from one another. In other words, the spring elements 34 are located obliquely to the longitudinal seat direction 8, enclosing an acute angle relative to one another in the mechanism 1.

The spring element 34 is acted upon during a pivoting of the backrest support 5 and thus a movement of the seat support 4 relative to the base support 2, i.e. the tension spring is tensioned. The spring path covered in this case is dependent on the position of the front point of action 40, i.e. the position of the threaded nut 36 on the pivoting strip 18, relative to the rear point of action 41 of the spring element 34.

The manner of the adjustment of the pivoting resistance is described hereinafter. The position of the front point of action 40 of the spring element 34 on the pivoting strip 18 is able to be altered by using an adjustment device 44, as explained in detail with reference to FIG. 11. To this end, a threaded spindle 45 serving as a guide element is provided, the threaded nut 36 being guided thereon and being movably positioned along the bearing 35 of the pivoting strip 18. In this case, for altering the position of the front point of action 40 of the spring element 34 the threaded nut 36 is able to be moved between a position 46 in the vicinity of the base support connecting point and a position 47 in the vicinity of the seat support connecting point and is able to be positioned steplessly in any position between these two end positions 46, 47, whereby a particularly easy adjustment of the pivoting resistance of the backrest is permitted.

Advantageously, the distance between the front point of action 40 of the spring element 34 on the pivoting strip 18 and the rear point of action 41 of the spring element 34 on the seat support 4 or the backrest support 5 does not alter when changing the position of the front point of action 40, so that an adjustment of the pivoting resistance is possible "without force." In other words, the spring length is not altered during the adjustment, so that the spring force of the spring element 34 does not have to be acted against. In particular, with such an adjustment the spring element 34 is not pretensioned. This is achieved by the bearing 35, which defines the guide track for the threaded nut 36, being formed by a circular portion, wherein the effective direction of the spring element 34 located in a longitudinal axis 48 of the spring element 34 corresponds to the radius of a circular path 49. In other words, the central point of the circular path 49 is defined by the rear point of action 41 of the spring element 34.

If a pivoting strip 18 is used with a differently constructed bearing 35, in which instead of the circular path 49 a track with a non-uniform radius is formed, for example a track extending in a linear manner or a non-circular track extending in a differently defined manner, when adjusting the pivoting resistance the pretensioning of the spring element 34 is specifically altered at the same time.

In a position pivoted to the rear, as seen in FIGS. 8 and 10, the projection 30 of the seat support 4 pulls the pivoting strip 18 on the seat support side to the rear in the longitudinal seat direction 8. Since the end 21 of the pivoting strip 18 on the base support side is fastened to the base support 2, the pivoting strip 18 is located obliquely. As a result, a spring force component of the spring element 34 acting in the direction of the projection 30, acts on the threaded nut 36. A movement of the threaded nut 36 on the threaded spindle 45 in this direction is excluded, however, since the pairing of the threaded spindle 45 and the threaded nut 36 is constructed to be self-locking at least in an oblique position of the threaded spindle 45 when the backrest is pivoted.

The threaded spindle 45 is held on only one side in its position through the bearing 35 of the pivoting strip 18. To this end, it has a connecting piece 51 configured in the manner of a spherical head at its end on the seat support side, the connecting piece engaging in an articulated manner in a corresponding spherical head receiver 52 in the projection 30, as is seen in FIG. 11 once again. The threaded spindle 45 extends in this case on the end 28 of the pivoting strip 18 on the seat support side in the region of the angled-back lug 31 of the pivoting strip 18 between the upper and the lower side wall 27 of the pivoting strip 18, which between one another form a corresponding spindle receiver 53, at least in the end 28 of the pivoting strip 18 on the seat support side, as is seen in FIGS. 8 and 10. As a result, the threaded spindle 45 and the pivoting strip 18 have the same point of rotation on the projection 30 on the seat support side, so that when the backrest is pivoted it does not result in an offset between the threaded nut 36 guided by the threaded spindle 45, on one hand, and the bearing 35 of the pivoting strip 18, on the other hand, i.e. the threaded nut 36 always bears optimally on the bearing 35 of the pivoting strip 18. The connecting piece 51 of the threaded spindle 45 is configured so that it is able to absorb compressive forces acting in the direction of the projection 30, the compressive forces being produced by corresponding spring force components when the backrest is pivoted.

As is already understood from the previous description, a pivoting of the backrest causes an alteration both to the position and the location of the pivoting strip 18. As the seat support 4 in the pivoting direction 11 moves downwardly to the rear, and the pivoting strip 18 is articulated on the projection 30 of the seat support 4 only in one point of rotation, when the backrest is pivoted the pivoting strip 18 has to be tilted relative to the base support 2. In particular, this results in a tilting of the pivoting strip 18 about the pivot pin 23 of the support element 24, as is also immediately clear from a comparison of the positions of the pivoting strips 18 in FIGS. 7 and 8 and/or in FIGS. 9 and 10. The pivoting strip 18, however, is also retained correctly in its tilted position between the base support 2 and the seat support 4 since in this state it is acted upon by the spring element 34 in the direction of the rear points of action 41. Additionally, the pivoting strip 18 is retained on its side walls 27 at least by parts of the connecting elements 25, 32, both on the base support side and on the seat support side.

Figure 12:
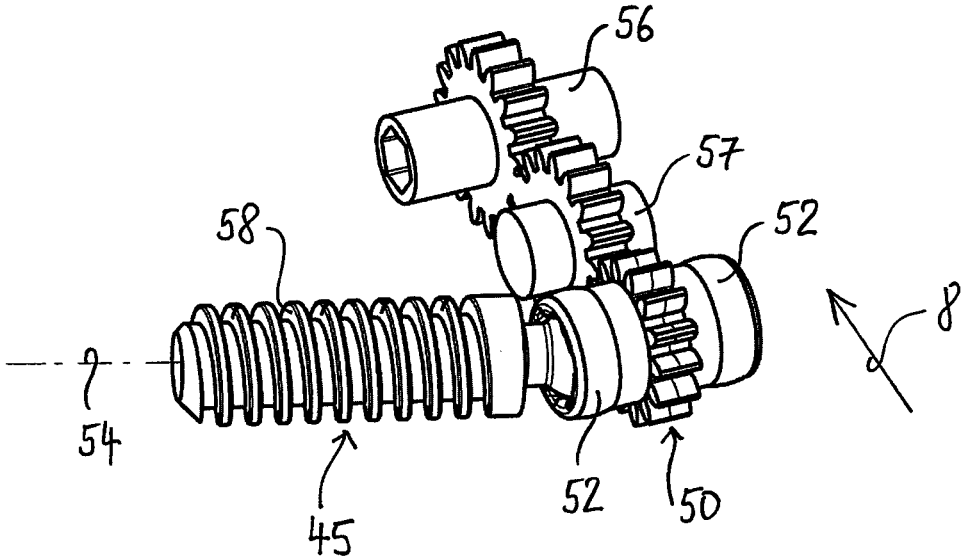
FIG. 12 is a fragmentary, perspective view of the adjustment device.

An adjustment of the position of the threaded nut 36 on the threaded spindle 45 takes place by a rotation of the threaded spindle 45 about the longitudinal axis 54 thereof, as is seen in FIG. 11. In this case, each displacement of the threaded nut 36 in the direction of the position 46 in the vicinity of the base support connecting point increases the spring path of the spring element 34 when the backrest is pivoted. The connecting piece 51 configured as a spherical head is used for transmitting a torque to the threaded spindle 45. To this end, the spherical head receiver 52 is able to be driven by a non-illustrated actuating element able to be operated manually, for example in the form of a hand wheel or the like, through a gearwheel mechanism, as is seen in FIG. 12. A transmission element connected to the actuating element, in this case in the form of a rotary bar 55, drives a drive wheel 56 disposed in the projection 30 and provided with a toothed ring. Through the use of a gearwheel 57 in engagement with the drive wheel 56 and also disposed in the projection 30, the torque is transmitted to the receiver component 50 which is also provided to this end with a toothed rim, wherein the receiver component encompasses the two spherical head receivers 52, in which the connecting pieces 51 of the threaded spindles 45 are located in an articulated and rotational manner, but without a rotational degree of freedom. By rotating the rotary bar 55, the receiver component 50, the spherical head receivers 52 and thus also the threaded spindles 45 located therein are set in rotation. The receiver component 50 as well as the further components 56, 57 of the gear mechanism are mounted in a suitable manner in the projection 30. Alternative possibilities for driving the threaded spindles 45, for example, include the use of Bowden cables or the use of universal joints.

Preferably, as shown in the figures, both threaded spindles 45 of the mechanism 1 are driven by a common actuating element and a single rotary bar 55. To this end, the threaded spindles 45 are provided with threads 58 in opposing directions (right-hand and left-hand thread).

Further embodiments of the invention are possible. Deviating from the above-described embodiment in which the support element is guided on a track by using a guide element, in a simplified variant it is possible that the track element itself serves as a guide element, for example. In other words, the support element is then guided by or through the track element. The track element and support element therefore directly cooperate, without requiring an additional guide element. A variant is also possible which is even more simple structurally, in which the spring element is able to be connected at different points directly to the track element, for example it may be suspended in the track element. The spring ends serve in this case as virtual support elements. Easy adjustment of the pivoting resistance by simply altering the front point of action of the spring element is, however, naturally no longer possible.

All of the features shown and described, the following claims and the drawings may be important to the invention both individually and in any combination with one another.

The invention claimed is:

1. A mechanism for an office chair, the mechanism comprising:

a base support configured to be placed on a chair column;

a seat support disposed on said base support and configured to be moved relative to said base support;

a backrest coupled to said seat support and configured to be disposed on a backrest support, said backrest configured to pivot to effect a movement of said seat support relative to said base support;

two track elements disposed symmetrically relative to a center longitudinal plane of said seat support and each being movably connected to said base support at a respective base support connecting point and each being movably connected to said seat support at a respective seat support connecting point, each of said track elements respectively having at least one of a position or a location being altered by pivoting of said backrest;

two spring elements acting on said track elements and on said seat support or acting on said backrest or said backrest support, said spring elements being acted upon by a movement of said seat support relative to said base support; and each of said spring elements having a respective track element point of action on a corresponding one of said tracks elements being variable in position.

2. The mechanism according to claim 1, which further comprises respective adjustment devices for altering the position of each said respective track element point of action.

3. The mechanism according to claim 2, wherein each of said adjustment devices respectively includes a guide element and a support element guided by said guide element, said support element being supported on a corresponding one of said track elements and as a result said support element determining each said respective track element point of action.

4. The mechanism according to claim 3, wherein said guide element is a threaded spindle and said support element is a threaded nut guided on said threaded spindle and movably connected to a corresponding one of said spring elements.

5. The mechanism according to claim 4, wherein said threaded spindle has a longitudinal axis, and said threaded nut is movable on said threaded spindle by a rotation of said threaded spindle about said longitudinal axis thereof.

6. The mechanism according to claim 5, which further comprises an actuating element configured to be driven manually or by electric motor for effecting the rotation of said threaded spindle.

7. The mechanism according to claim 3, which further comprises a respective track defined by each of said tracks elements, said support element being movable on said track between a position in a vicinity of said respective base support connecting point and a position in a vicinity of said respective seat support connecting point for altering the position of said respective track element point of action.

8. The mechanism according to claim 7, wherein each of said adjustment devices is configured to permit said support element to be positioned steplessly at any point of said track between said position in the vicinity of said respective base support connecting point and said position in the vicinity of said seat respective support connecting point.

9. The mechanism according to claim 2, wherein:

each of said springs elements acts on said seat support or on said backrest or said backrest support at a respective backrest point of action; and said respective adjustment device is configured to prevent a distance between said respective track element point of action and said respective backrest point of action from changing when changing the position of said respective track element point of action.

10. A mechanism for an office chair, the mechanism comprising:

a base support configured to be placed on a chair column;

a seat support disposed on said base support and configured to be moved relative to said base support;

a backrest coupled to said seat support and configured to be disposed on a backrest support, said backrest configured to pivot to effect a movement of said seat support relative to said base support;

a track element being movably connected to said base support at a base support connecting point and being movably connected to said seat support at a seat support connecting point, said track element having at least one of a position or a location being altered by pivoting of said backrest;

a spring element acting on said track element and on said seat support or acting on said backrest or said backrest support, said spring element being acted upon by a movement of said seat support relative to said base support; and said spring element having a point of action on said track element being variable in position an adjustment device for altering the position of said point of action of said spring element on said track element, said adjustment device including a guide element and a support element guided by said guide element, said support element being supported on said track element and as a result said support element determining said point of action of said spring element on said track element, said guide element being a threaded spindle and said support element being a threaded nut guided on said threaded spindle and movably connected to said spring element, said threaded spindle having a longitudinal axis, and said threaded nut being movable on said threaded spindle by a rotation of said threaded spindle about said longitudinal axis thereof;

an actuating element configured to be driven manually or by electric motor for effecting the rotation of said threaded spindle;

a spherical head receiver disposed on said seat support and configured to be indirectly or directly driven by said actuating element;

said threaded spindle having an end configured as a spherical head engaging in an articulated manner in said spherical head receiver for transmitting a torque to said threaded spindle.

11. The mechanism according to claim 1, wherein at said respective base support connecting point, each track element is connected to a respective support element that is pivotably fastened to said respective base support and which extends substantially in a seat support longitudinal direction.

12. The mechanism according to claim 1, wherein, at said respective seat support connecting point, each track element is connected to a central projection of the seat support, said central projection extends from a front seat support transverse frame running in a seat support longitudinal direction.

13. The mechanism according to claim 12, wherein each of said two spring elements act with each said respective track element point of action on opposite sides of said projection.

14. The mechanism according to claim 13, wherein, in a position of said backrest pivoted to the rear, said projection pulls said two track elements to the rear in the seat support longitudinal direction.

15. The mechanism according to claim 1, wherein a pivoting of said backrest causes an alteration of both a position and location of said two track elements.

16. The mechanism according to claim 15, wherein each of said track elements are articulated on the projection in only one respective point of rotation.

17. The mechanism according to claim 16, wherein, during pivoting of said backrest, said seat support moves downwardly to the rear and said two track elements are tilted relative to said base support.

* * * * *